US008459235B2

(12) United States Patent
Achor

(10) Patent No.: US 8,459,235 B2
(45) Date of Patent: Jun. 11, 2013

(54) MARINE FUEL DELIVERY SYSTEM WITH PLASTIC HOUSING AND METHOD OF CONSTRUCTION THEREOF

(75) Inventor: Kyle D. Achor, Monticello, IN (US)

(73) Assignee: Federal-Mogul Corporation, Southfield, MI (US)

( * ) Notice: Subject to any disclaimer, the term of this patent is extended or adjusted under 35 U.S.C. 154(b) by 572 days.

(21) Appl. No.: 12/768,398

(22) Filed: Apr. 27, 2010

(65) Prior Publication Data

US 2010/0273370 A1 Oct. 28, 2010

Related U.S. Application Data

(60) Provisional application No. 61/172,860, filed on Apr. 27, 2009.

(51) Int. Cl.
*F02M 37/04* (2006.01)

(52) U.S. Cl.
USPC ..... 123/509; 123/516; 123/198 D

(58) Field of Classification Search
USPC ..... 123/509, 516, 198 D
See application file for complete search history.

(56) References Cited

U.S. PATENT DOCUMENTS

| | | | | |
|---|---|---|---|---|
| 5,024,188 | A | 6/1991 | Hartke et al. | |
| 5,203,306 | A | 4/1993 | Billingsley et al. | |
| 5,647,330 | A | 7/1997 | Sawert et al. | |
| 5,797,378 | A * | 8/1998 | Kato | 123/516 |
| 5,832,903 | A | 11/1998 | White et al. | |
| 5,964,206 | A | 10/1999 | White et al. | |
| 6,029,633 | A | 2/2000 | Brandt | |
| 6,073,614 | A | 6/2000 | Kleppner | |
| 6,260,543 | B1 | 7/2001 | Chih | |
| 6,267,094 | B1 | 7/2001 | Kuettner et al. | |
| 6,358,412 | B1 | 3/2002 | Strohl et al. | |
| 6,561,773 | B1 * | 5/2003 | Fischer | 417/366 |
| 6,581,579 | B1 | 6/2003 | Knight et al. | |
| 6,648,706 | B2 | 11/2003 | Kanno | |
| 6,857,419 | B1 | 2/2005 | Harvey et al. | |
| 6,923,164 | B1 | 8/2005 | Mitsudou et al. | |
| 6,981,490 | B2 | 1/2006 | Nagata et al. | |
| 7,013,878 | B1 * | 3/2006 | Cotton et al. | 123/518 |
| 7,069,914 | B2 | 7/2006 | Nagata | |
| 7,225,797 | B2 | 6/2007 | Zdroik | |
| 7,353,809 | B2 * | 4/2008 | Peterson et al. | 123/516 |
| 7,401,598 | B2 | 7/2008 | Ochiai | |
| 7,431,021 | B1 | 10/2008 | Achor | |
| 7,568,470 | B2 | 8/2009 | Kamito et al. | |
| 2007/0084784 | A1 | 4/2007 | Wehrum | |
| 2009/0025692 | A1 | 1/2009 | Wattai et al. | |

FOREIGN PATENT DOCUMENTS

| | | | |
|---|---|---|---|
| JP | 2004-253711 | A | 9/2004 |
| WO | WO2005001943 | A1 | 1/2005 |

* cited by examiner

*Primary Examiner* — Thomas Moulis
(74) *Attorney, Agent, or Firm* — Robert L. Stearns; Dickinson Wright, PLLC

(57) ABSTRACT

A marine fuel delivery system and method of construction thereof provides at least one of a fuel filter housing and a fuel vapor separator housing with a lower support cap extending laterally therefrom, with the lower support cap being formed as a single piece of plastic material with the fuel filter housing and/or fuel vapor separator housing. In addition, the system includes a heat shield extending upwardly from the lower support cap. The fuel filter housing and/or fuel vapor separator housing; the lower support cap and the heat shield are constructed as a monolithic piece of thermoset plastic that does not melt when directly exposed to a 650° C. flame for 2½ minutes.

22 Claims, 4 Drawing Sheets

MARINE FUEL DELIVERY SYSTEM WITH PLASTIC HOUSING AND METHOD OF CONSTRUCTION THEREOF

CROSS-REFERENCE TO RELATED APPLICATION

This application claims the benefit of U.S. Provisional Application Ser. No. 61/172,860, filed Apr. 27, 2009, which is incorporated herein by reference in its entirety.

BACKGROUND OF THE INVENTION

1. Technical Field

This invention relates generally to marine fuel delivery systems, and more particularly to stern drive and inboard marine fuel delivery systems.

2. Related Art

Marine fuel delivery components, such as a fuel vapor separator assembly, is typically assembled from components constructed separate from one another and from metallic materials, such as aluminum and steel. Upon being constructed, the components are commonly bundled together as a unitized module. The primary purpose for using metallic materials, particularly in stern drive and inboard marine applications, wherein the fuel delivery system is housed inside the boat and not directly exposed externally to the boat, is to meet requirements for resistance to heat and to meet burn test requirements under the US Coast Guard requirement 183.590. Unfortunately, although the metal components meet the heat and burn test requirements, over time, they are susceptible to corrosion, particularly in salt water environments. As such, the metal components are typically coated, such as by way of electrodepositing paint on the outer surface of the metal component, to inhibit the onset of corrosion. Unfortunately, by having to apply a coating material to the metal components, the material costs are increased, as well as the cost associated with manufacturing. In addition, the coatings can be susceptible over time to attack by the liquid fuel. Thus, some efforts have been made to replace the coated metal components with plastic components, however, the plastic components are unable to meet the aforementioned burn test requirements.

SUMMARY OF THE INVENTION

A fuel delivery system for a stern drive or inboard marine engine constructed in accordance with one aspect of the invention utilizes a configuration of plastic material capable of passing the heat and burn test requirements under the US Coast Guard requirement 183.590. The plastic material can be formed as a single, monolithic piece of material configured to provide at least a portion of two or more components, thereby doing away with some of the individually constructed components of known fuel delivery systems. In addition, the plastic material is able to resist corrosion, particularly from oxidation and exposure to salt water, without having to be coated. Further, the component or components are able to be molded to conform or substantially conform to adjacent engine features or other structure, thereby avoiding the formation of potential "heat pockets" or heat traps. Accordingly, the number of system components and the manufacturing costs associated therewith are reduced, while the ability to package the individual components in an efficient envelope (work space) is enhanced.

One fuel delivery system constructed in accordance with the invention provides a marine fuel delivery system including at least one of a fuel filter housing and a fuel vapor separator housing with a lower support cap extending laterally therefrom, with the lower support cap being formed as a single piece of plastic material with the fuel filter housing and/or fuel vapor separator housing. In addition, the system includes a heat shield extending upwardly from the lower support cap. The fuel filter housing and/or fuel vapor separator housing; the lower support cap and the heat shield are constructed as a monolithic piece of thermoset plastic that does not melt when directly exposed to a 650° C. flame for 2½ minutes.

In accordance with another aspect of the invention, the heat shield is configured to shield a high pressure fuel pump that is located externally to the fuel vapor separator housing from exposure to radiant heat.

In accordance with yet another aspect of the invention, a mount plate extends upwardly from the lower support cap opposite the heat shield, with the mount plate being formed as a single piece of plastic material with the fuel filter housing and the lower support cap. The fuel vapor separator housing is configured in fluid communication with the filter housing, wherein the fuel vapor separator housing has a vapor vent port to allow fuel vapor to be separated from liquid fuel within the fuel vapor separator housing and vented outwardly therefrom.

In accordance with another aspect of the invention, a marine fuel delivery system constructed in accordance with the invention provides a fuel vapor separator assembly including a fuel filter housing and a fuel vapor separator housing formed as a single piece of thermoset plastic material with one another. The plastic material is capable of passing the aforementioned heat and burn test requirements under the US Coast Guard requirement 183.590.

In accordance with yet another aspect of the invention, a method of constructing a component for a marine fuel delivery system is provided. The method includes molding at least one of a fuel filter housing and fuel vapor separator housing with an integrally molded lower support cap extending from the housing and an integrally molded heat shield extending upwardly from the lower support cap using a thermoset plastic that does not melt when directly exposed to a 650° C. flame for 2½ minutes.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
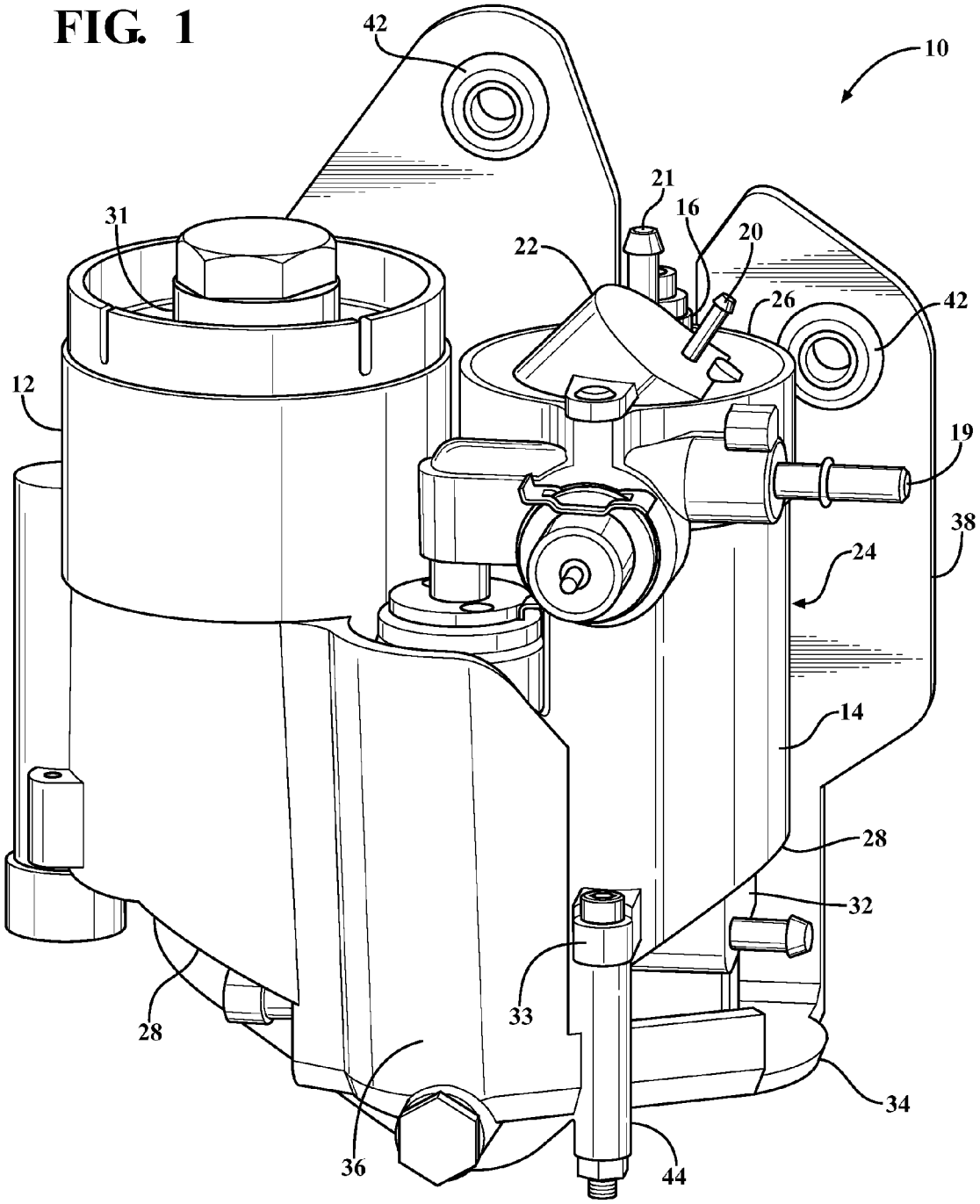
FIG. 1 is a perspective view of a marine fuel delivery system constructed in accordance with one aspect of the invention.

Referring in more detail to the drawings, FIG. 1 illustrates marine fuel delivery system, also referred to hereafter as a fuel vapor separator assembly or simply assembly 10, constructed in accordance with one aspect of the invention. The assembly 10 functions as a fuel delivery system for a stern drive or inboard marine engine and is constructed using a plastic material capable of passing the heat and burn test requirements under the US Coast Guard requirement 183.590, which requires an ability to withstand exposure to a flame at 650° C. for 2½ minutes without melting, for constructing a substantial portion of the assembly, particularly the outwardly exposed surfaces. Being constructed from the plastic material, the components material cost and manufacturing cost associated therewith are reduced, and in addition, the plastic material is able to resist corrosion, particularly from oxidation and exposure to salt water, without having to be coated, and is able to be shaped in efficient configurations, thereby allowing a the assembly 10 to be mounted within a minimal envelope.

In the embodiment illustrated, the assembly 10 has a fuel filter housing 12 and a vapor separator reservoir, referred to hereafter as reservoir or vapor separator housing 14, constructed from the aforementioned plastic material. The fuel filter housing 12 is configured to receiving a fuel filter 13 therein and the reservoir 14 functions to separate fuel vapor from the liquid fuel therein. The plastic material, unlike standard thermoplastic materials that melt at about 300° C., is able to shield heat and withstand the aforementioned burn test without melting, and thus, the finished plastic component passes the test and any components shield by the plastic material are protected from exposure to the heat. The plastic material believed best suited to construct the fuel filter housing 12 and the reservoir 14 is a thermoset plastic formed of a mineral filled glass fiber-reinforced vinyl ester compound suitable for compression and injection molding. One such plastic material is commercially available and is sold under the name BMC 685 or BMC 695, and can be purchased from Bulk Molding Compounds, Inc. of West Chicago, Ill.

The assembly 10 includes a low pressure pump 16 and a high pressure pump 18. The low pressure pump 16 functions to pump liquid fuel from an upstream fuel tank (not shown) through the fuel filter housing 12 wherein the liquid fuel passes through and is filtered by the filter 13. The low pressure pump 16 then pumps the filtered liquid fuel into the reservoir 14, wherein the low pressure pump 16 is represented in FIG. 1 as being external to the reservoir 14. The high pressure pump 18, also represented in FIG. 1 as being external to the reservoir 14, then pumps liquid fuel from the reservoir 14 through a high pressure fuel outlet port 19 to a fuel injector array of an internal combustion engine (not shown).

The reservoir 14 functions to separate fuel vapor from the liquid fuel, and can have a separator wall or walls molded therein as single pieces of the plastic material with the reservoir, as desired. The fuel vapor, upon being separated from the liquid fuel, is vented from the reservoir 14, such as through a vapor vent port 20. The vapor vent port 20, in addition to a water cooling port 21, are represented here as being formed in an upper reservoir cap or cover 22. The upper reservoir cap 22 is constructed as a separate piece of the plastic material and can be molded having any desired fittings and shape. The reservoir 14 has a generally cylindrical wall 24 extending between an upper end 26 adjacent the upper cover 22 and a lower end or base 28. The upper end 26 is shown as extending along a plane that is generally perpendicular to a longitudinal central axis 30 of the reservoir 14 and the base 28 is shown as being molded having a sloped surface in oblique relation to the axis 30 to accommodate the orientation in which the reservoir 14 is mounted for use. The base 28 can be molded having the desired fittings and/or openings, such as a port 32 for attachment to a water cooling coil, such as a spiral wound coiling coil (not shown) sized for receipt in the reservoir 14 and/or fuel lines for inflow and outflow of liquid fuel from the fuel filter housing 12 and to the high pressure pump 18, respectively. Further, as shown in FIG. 1, the reservoir 14 can be molded having mounting features, shown here as bolt passages 33 to facilitate attaching the reservoir 14 to the fuel filter housing 12.

The fuel filter housing 12 has an upper cover or cap 31 and a lower support base or cap 34 extending laterally therefrom, with the lower support cap 34 being formed as a single monolithic piece of plastic material with the fuel filter housing 12. In addition, an upstanding support heat shield 36 extends upwardly from the lower support cap 34, with the heat shield 36 being attached to and formed as a single monolithic piece of the plastic material with the fuel filter housing 12 and the lower support cap 34. The heat shield 36 is configured to shield the externally mounted high pressure fuel pump 18 from exposure to heat and flame, and is shown as having a partial cylindrical configuration, though, it should be recognized that being an "as molded" component, the heat shield 36 can be configured having any suitable geometry to provide the desired external and internal configuration.

Figure 2:
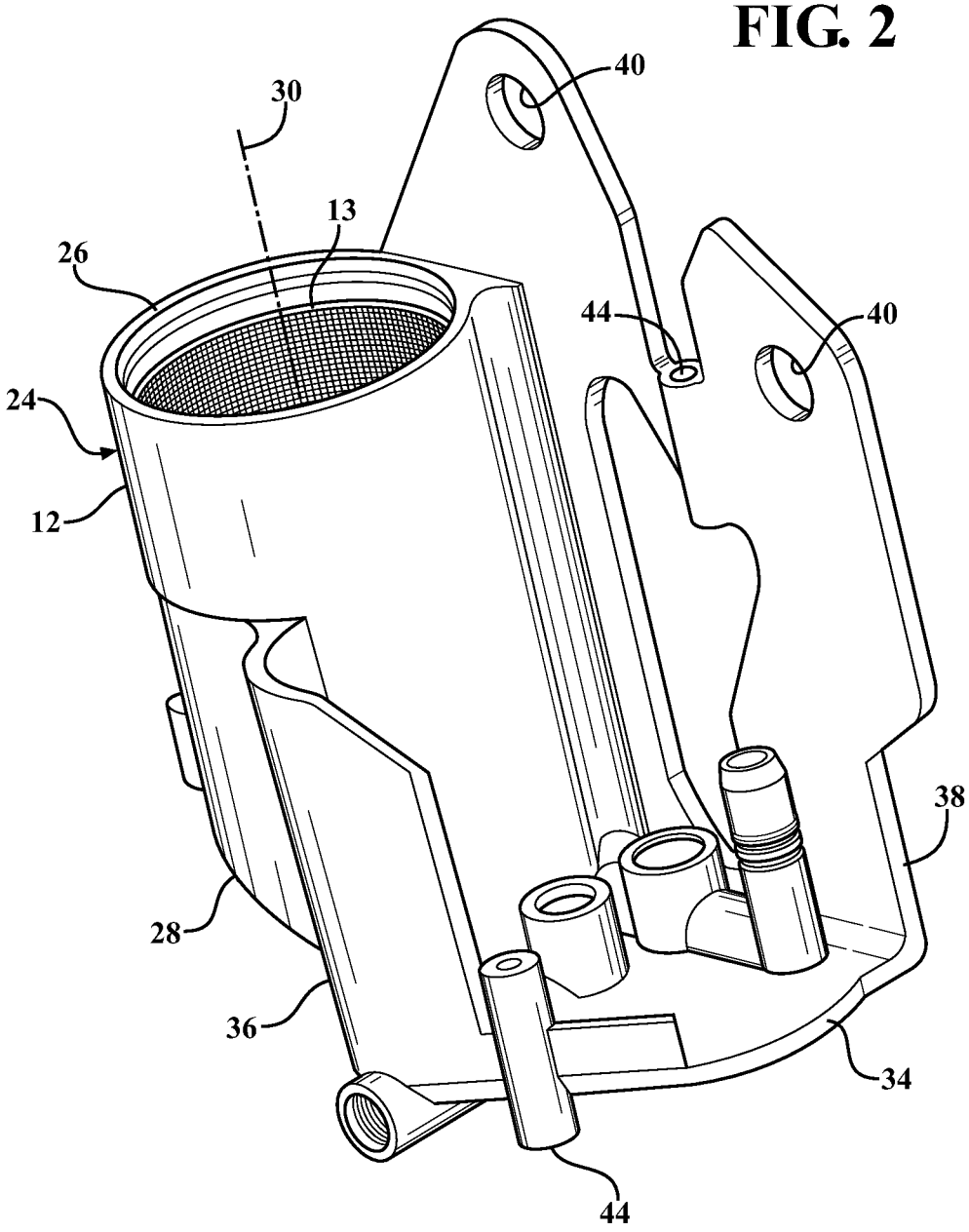
FIG. 2 is a perspective view of a monolithic fuel filter housing and heat shield of the marine fuel delivery system of FIG. 1.

Further, the monolithic "as molded" plastic component preferably includes a mount plate 38 that extends upwardly from an opposite side of the lower support cap 34 from the heat shield 36, such that the mount plate 38 and heat shield 36 are laterally spaced from one another a suitable distance to receive the desired components therebetween. As best shown in FIG. 2, the mount plate 38 extends directly from the fuel filter housing 12 and the lower support cap 34. The mount plate 38 is preferably molded having through openings 40 for mounting the fuel filter housing 12, and thus, the assembly 10 to a support structure (not shown). As illustrated, grommets 42 are disposed in each of the openings 40. In addition, the mount plate 38 is preferably molded having mounting features, shown here as bolt through passages 44 configured to align with the bolt passages 33 on the reservoir 14 to facilitate mounting the reservoir 14 thereto.

Figure 3:
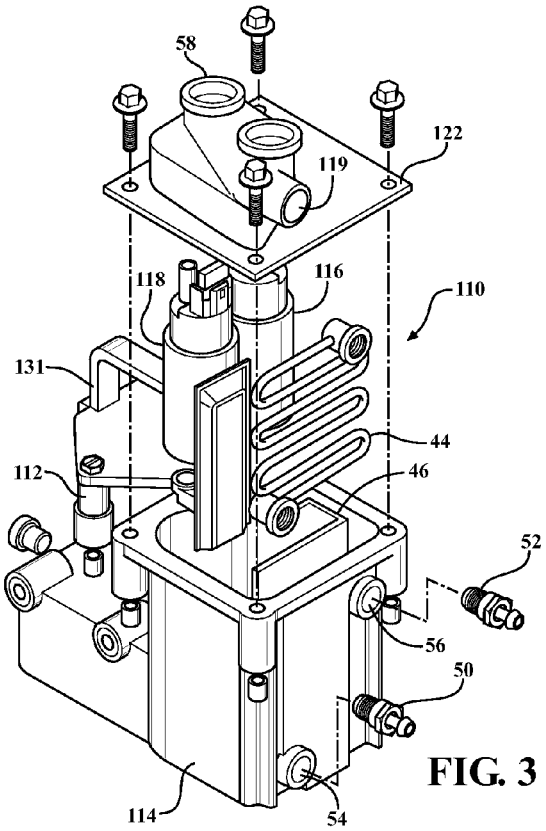
FIG. 3 is an exploded perspective view of a marine fuel delivery system constructed in accordance with another aspect of the invention.
Figure 4:
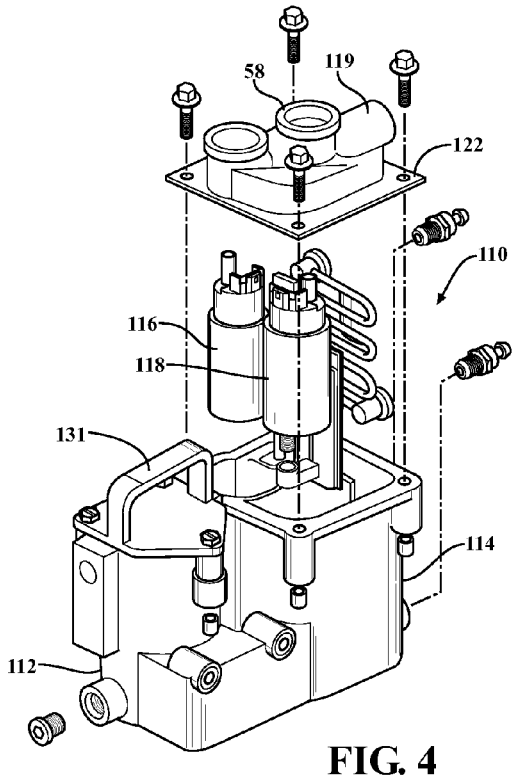
FIG. 4 is another exploded perspective view of the marine fuel delivery system of FIG. 3 taken from a different perspective.
Figure 5:
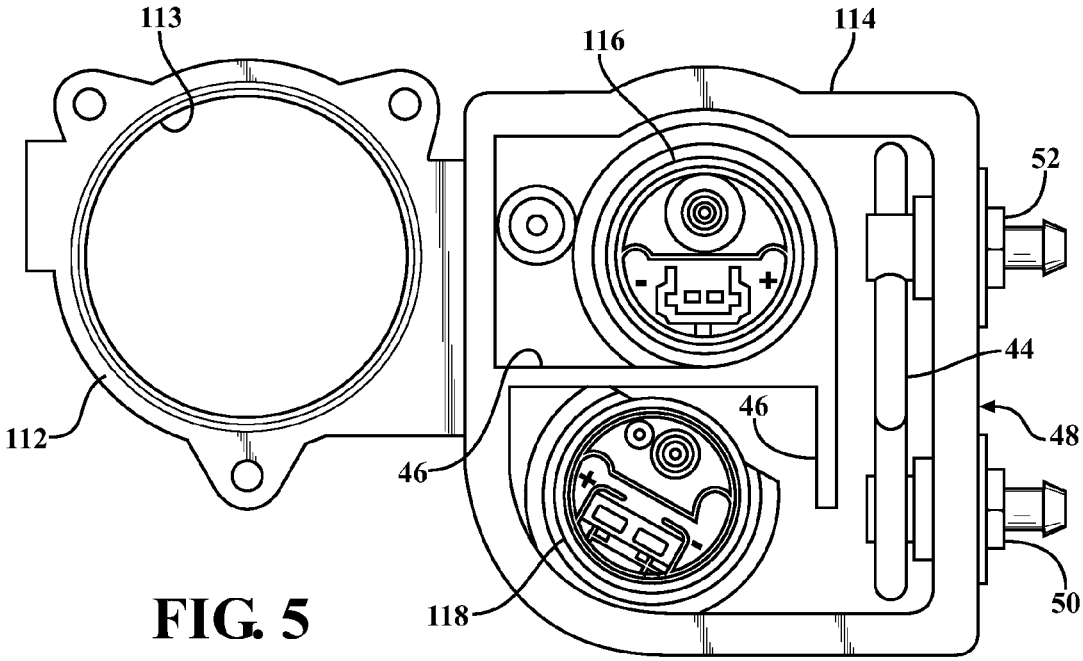
FIG. 5 is a top view of the marine fuel delivery system of FIG. 3 shown with covers removed therefrom.

In FIGS. 3-5, a marine fuel delivery system, also referred to as fuel vapor separator assembly 110, constructed in accordance with another aspect of the invention is shown, wherein the same reference numerals offset by a factor of 100 are used to identify like features. The assembly 110 has a fuel filter housing 112, a reservoir 114, low and high pressure pumps 116, 118 and a cooling coil 44. Unlike the previous embodiment, the fuel filter housing 112 and the reservoir 114 are constructed as a single, monolithic piece of the thermset plastic material. Further, rather than the low and high pressure pumps 116, 118 being external to the reservoir 114, they are both received inside the reservoir 114, such that the plastic wall of the reservoir 114 functions a heat shield to the pumps 116, 118. Further yet, to facilitate locating the pumps 116, 118 and regulating the flow of liquid fuel and fuel vapor flow and separation, a baffle wall or walls 46 are molded as a single piece of the plastic material with the reservoir 114. In the embodiment shown, at least a portion of the baffle wall 46 extends between the pumps 116, 118, wherein the high pressure fuel pump 118 is received within a close fitting cavity provided by a semi-cylindrical or slightly greater than semi-cylindrical portion of the baffle wall 46 and the low pressure fuel pump 116 is received within a cylindrical walled portion of the baffle wall 46. Depending on the fuel flow requirements, the baffle wall 46 can be formed having a variety of configurations, particularly given the simplicity of being molded as one piece of plastic material with the reservoir 114. In addition, to facilitate locating the cooling coil 44 in the reservoir 114 and coupling water inlet and outlet fittings 50, 52 to the cooling coil 44, a sidewall 48 of the reservoir 114 can have an inlet opening 54 and an outlet opening 56 molded therein.

Upper caps 131, 122 are molded separately using the plastic material to cover the fuel filter housing 112 and reservoir 114, respectively. The reservoir upper cap 122 is formed having a high pressure fuel outlet port 119 and a pressure regulator port 58 molded therein.

Figure 5A:
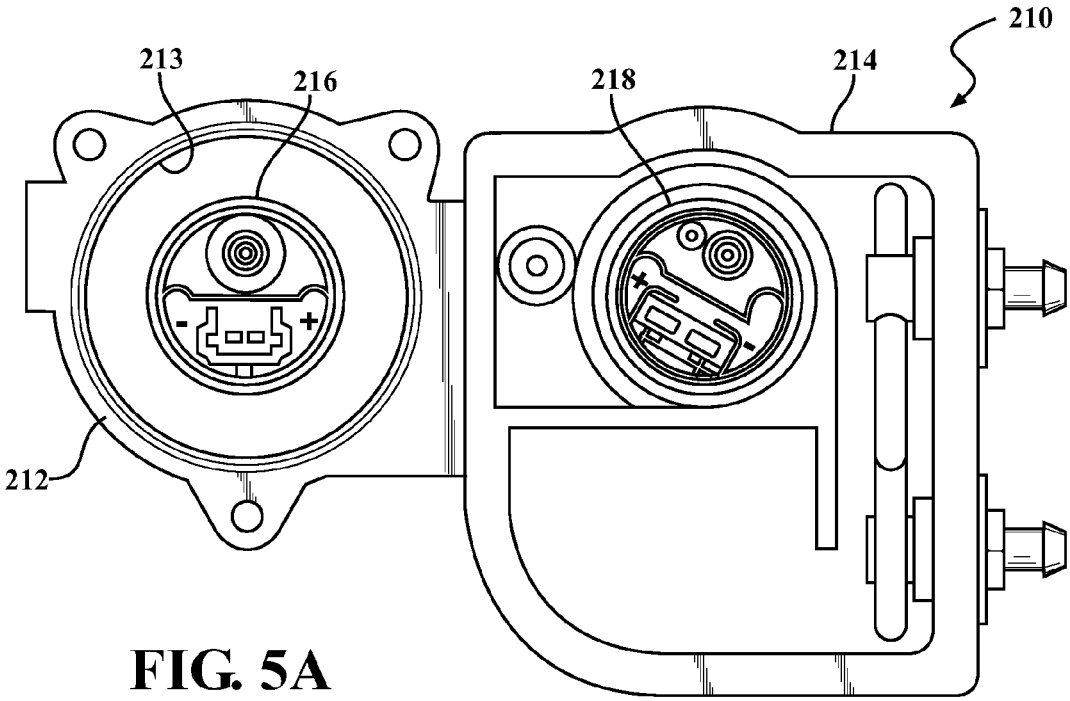
FIG. 5A is a view similar to FIG. 5 of a marine fuel delivery system constructed in accordance with another aspect of the invention.

In FIG. 5A, a marine fuel delivery system, also referred to as fuel vapor separator assembly 210, constructed in accordance with another aspect of the invention is shown, wherein the same reference numerals offset by a factor of 200 are used to identify like features. The assembly 210 is very similar to the previously discussed assembly, however, rather than the low and high pressure pumps 216, 218 being internal to a single fuel vapor separator reservoir 214, the high pressure fuel pump 218 is received inside the reservoir 214, while the low pressure fuel pump 216 is received concentrically within a cylindrical fuel filter 213 within a fuel filter housing 212. Otherwise, the assembly 210 remains as discussed with regard to the assembly 110.

In the embodiments 10, 110, 210 discussed above, the external contour of all the molded plastic components can be molded to conform or substantially conform with adjacent structures. As such, the formation of heat pockets, also referred to as heat traps, is avoided. Further, the outer surface contours of the plastic components can be molded having smooth and rounded corners, thereby further avoiding the formation of heat traps. For example, the filter housing 12 is shown its base formed in oblique relation to the axis 30, wherein the base is generally horizontal upon assembly to the engine and in abutting, flush relation with the adjacent engine surface. As such, there is no formation of a heat trap between the base 28 and the adjacent engine surface.

Obviously, many modifications and variations of the present invention are possible in light of the above teachings. It is, therefore, to be understood that within the scope of any ultimately allowed claims, the invention may be practiced otherwise than as specifically described.

What is claimed is:

1. A marine fuel delivery system, comprising:

at least one of a fuel filter housing and fuel vapor separator housing;

a lower support cap extending from said at least one fuel filter housing or fuel vapor separator housing; and a heat shield extending upwardly from said lower support cap;

wherein said at least one fuel filter housing and fuel vapor separator, said lower support cap and said heat shield are constructed as a monolithic piece of thermoset plastic that does not melt when directly exposed to a 650° C. flame for 2½ minutes.

2. The marine fuel delivery system of claim 1 further including a mount plate extending from said lower support cap and being constructed as a monolithic piece of the thermoset plastic therewith.

3. The marine fuel delivery system of claim 2 wherein said mount plate is attached to said at least one of a fuel filter housing or fuel vapor separator housing.

4. The marine fuel delivery system of claim 2 wherein said mount plate and said heat shield extend from opposite sides of said lower support cap in laterally spaced relation from one another.

5. The marine fuel delivery system of claim 4 further including a high pressure fuel pump mounted externally to said fuel vapor separator housing and wherein said heat shield is configured to shield said high pressure fuel pump.

6. The marine fuel delivery system of claim 5 wherein said heat shield extends from said fuel filter housing.

7. The marine fuel delivery system of claim 5 further including a fuel vapor separator housing constructed as a separate piece of material from said lower support cap disposed between said heat shield and said mount plate.

8. The marine fuel delivery system of claim 1 wherein said lower support cap is constructed as a monolithic piece of thermoset plastic with both of said fuel filter housing and said fuel vapor separator housing.

9. The marine fuel delivery system of claim 8 further including a high pressure fuel pump and a lower pressure fuel pump disposed in said fuel vapor separator housing.

10. The marine fuel delivery system of claim 9 further including a baffle wall extending between said high pressure fuel pump and said low pressure fuel pump, said baffle wall being constructed as a monolithic piece of thermoset plastic with said fuel vapor separator housing.

11. The marine fuel delivery system of claim 8 further including a high pressure fuel pump disposed in said fuel vapor separator housing and a lower pressure fuel pump disposed in said fuel filter housing.

12. A method of constructing a component for a marine fuel delivery system, comprising:

molding at least one of a fuel filter housing and fuel vapor separator housing with an integrally molded lower support cap extending from the housing and an integrally molded heat shield extending upwardly from the lower support cap using a thermoset plastic that does not melt when directly exposed to a 650° C. flame for 2½ minutes.

13. The method of claim 12 further including molding a mount plate extending from the lower support cap as a monolithic piece of the thermoset plastic therewith.

14. The method of claim 13 molding the mount plate in attached relation with at least one of the fuel filter housing or the fuel vapor separator housing.

15. The method of claim 13 molding the mount plate and the heat shield on opposite sides of the lower support cap in laterally spaced relation from one another.

16. The method of claim 15 further including mounting a high pressure fuel pump between the fuel vapor separator housing and the heat shield.

17. The method of claim 16 further including molding the heat shield in attached relation with the fuel filter housing.

18. The method of claim 16 further including disposing a fuel vapor separator housing constructed as a separate piece of material from the lower support cap between the heat shield and the mount plate.

19. The method of claim 12 including molding the lower support cap as a monolithic piece of thermoset plastic with both the fuel filter housing and the fuel vapor separator housing.

20. The method of claim 19 further including disposing a high pressure fuel pump and a lower pressure fuel pump in the fuel vapor separator housing.

21. The method of claim 20 further including molding a baffle wall extending between the high pressure fuel pump and the low pressure fuel pump as a monolithic piece of thermoset plastic with the fuel vapor separator housing.

22. The method of claim 19 further disposing a high pressure fuel pump in the fuel vapor separator housing and disposing a lower pressure fuel pump in the fuel filter housing.

* * * * *